US005351820A

United States Patent [19]

Focke et al.

[11] Patent Number: 5,351,820

[45] Date of Patent: Oct. 4, 1994

[54] CIGARETTE CARTON WITH OPENINGS FOR REVENUE STAMPS

[75] Inventors: Heinz Focke, Verden; Hans-Jürgen Bretthauer, Bremen, both of Fed. Rep. of Germany

[73] Assignee: Focke & Co., Verden, Fed. Rep. of Germany

[21] Appl. No.: 894,336

[22] Filed: Jun. 4, 1992

[30] Foreign Application Priority Data

Jun. 18, 1991 [DE] Fed. Rep. of Germany ..... 4120059

[51] Int. Cl.[5] ..... B65D 85/10

[52] U.S. Cl. ..... 206/273; 206/45.31; 206/256; 206/264

[58] Field of Search ..... 206/256, 264, 273, 271, 206/813, 45.31

[56] References Cited

U.S. PATENT DOCUMENTS 2,129,701 9/1938 Malocsay .
2,548,985 4/1951 Lighter .
2,729,326 1/1956 Stadnyk .
2,895,601 7/1959 Krukonis ..... 206/45.31
3,063,553 11/1962 Nicholson .
3,596,758 6/1969 Phillips, Jr. et al. .
4,932,534 6/1990 Focke et al. ..... 206/273 X

FOREIGN PATENT DOCUMENTS 0251343 3/1984 European Pat. Off. .
344466 12/1989 European Pat. Off. .
2501640 7/1975 Fed. Rep. of Germany .
3313462 10/1984 Fed. Rep. of Germany .
8521126 11/1985 Fed. Rep. of Germany .

*Primary Examiner*—Bryon P. Gehman
*Attorney, Agent, or Firm*—Sughrue, Mion, Zinn, Macpeak & Seas

[57] ABSTRACT

A bundle pack, especially a cigarette carton, formed from a plurality of cuboid packages which are wrapped in an outer wrapper made of cardboard, paper or plastic film has to be designed such that the individual cigarette packages can be easily marked on one outer side without opening the outer wrapper. For this purpose, the outer wrapper is provided with cut-outs which are located in the region of the outer sides of the packages. Adjacent cut-outs (17) are delimited from one another by narrow webs (19) of the outer wrapper (14).

5 Claims, 2 Drawing Sheets

CIGARETTE CARTON WITH OPENINGS FOR REVENUE STAMPS

BACKGROUND OF THE INVENTION

The invention relates to a bundle pack, especially a cigarette carton, formed from a plurality of cuboid packages which are wrapped in an outer wrapper made of cardboard, paper or plastic foil.

Relatively small products such as cigarette packages are packed into larger bundles for easy handling during transport and in the shops. Individual cigarette packages are preferably grouped together by means of a further wrapper to form cigarette cartons. Revenue or tariff regulations of various countries require the application of revenue stamps on each individual cigarette package, particularly shortly before the package is sold to the ultimate consumer, Consequently, the stamps can not be affixed during packaging. Instead, the retailer has to open the bundle pack, affix the revenue stamps and subsequently reclose the bundle pack. This procedure is very time-consuming and uneconomical.

SUMMARY OF THE INVENTION

The object of the present invention is to design a bundle pack in such a way that individual packages can be provided with markings without the need of opening the pack or wrapper. It is a further object of the invention to provide a suitable blank for this purpose.

According to the invention, the object is attained by providing the outer wrapper in the region of an outer side of each enwrapped package with cut-outs which are suitable for the passage of stamping means or other marking means in order to apply (revenue) stamps to the package face. Consequently, it is no longer necessary to open the bundle pack for the application of markings.

Expediently, each package is associated with a separate cut-out in the outer wrapper, especially in the region of a bottom face of the packages. Adjacent cut-outs are preferably delimited by webs of the outer wrapper. As a result, it is avoided that the cut-outs are too large and thus easily damaged.

Further features relate to the structure and arrangement of the cut-outs, partly in conjunction with a specially designed bundle pack as shown in DE 33 13 462 A1 corresponding to U.S. Pat. No. 4,932,534. Other features are directed to a blank for forming an outer wrapper for a bundle pack.

BRIEF DESCRIPTION OF THE DRAWINGS

Advantageous exemplary embodiments of the invention are described below in more detail with reference to the drawings, in which.

DESCRIPTION OF PREFERRED EMBODIMENTS

Figure 1:
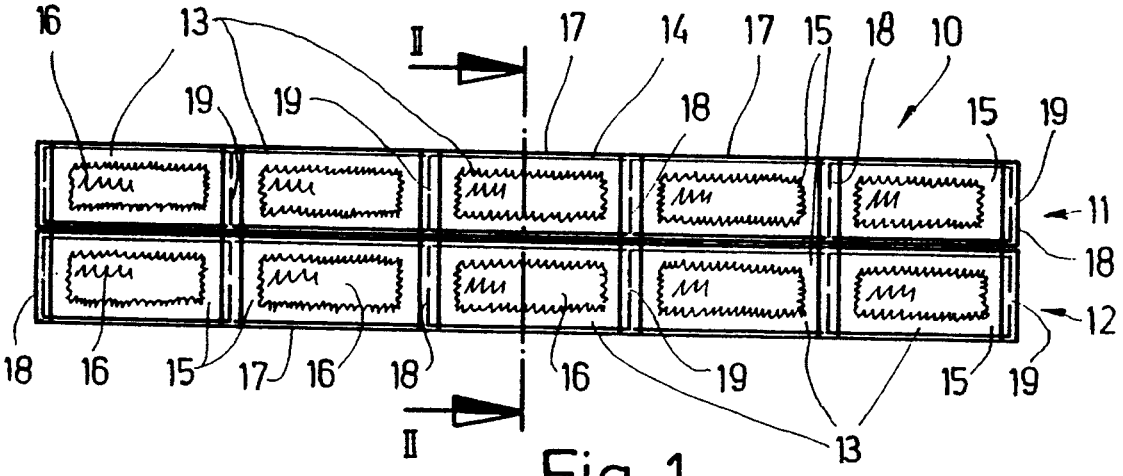
FIG. 1 is a side view of an exemplary embodiment of a bundle pack according to the invention, with cut-outs located in a narrow side.

A bundle pack 10 in the form of a so-called cigarette carton comprises two superimposed rows 11, 12 of cigarette packages 13. An outer wrapper 14 made of cardboard, paper or plastic foil retains the bundle pack 10 in its intended shape. FIG. 1 shows bottom faces 15 of the cigarette packages 13. A marking 16 is disposed on each bottom face 15. In order to apply the markings, the outer wrapper 14 comprises cut-outs 17 in the region of the bottom faces 15, in particular one cut-out for each bottom face. In the region of edges 18 located between the bottom faces 15 and narrow pack sides, the individual cut-outs 17 are separated from one another by means of webs 19. The cut-outs 17 extend across the entire width of the cigarette packages 13, i.e. in the direction of the section line II—II. As a result, it is possible to employ relatively large marking means for marking the packages. Because the webs 19 are arranged to cover adjacent edges 18, individual cigarette packages 13 can not fall out of the bundle pack 10.

Figure 2:
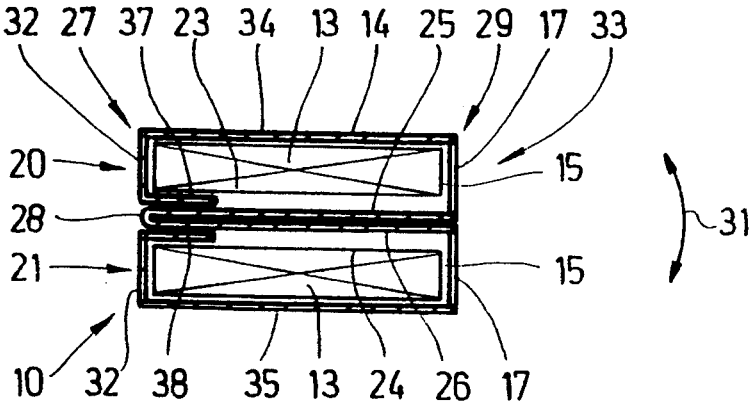
FIG. 2 shows a section through a bundle pack of FIG. 1, taken on line II—II.

FIG. 2 shows a special feature of the bundle pack 10. This pack is dividable into two partial bundles 20, 21. For this purpose, the outer wrapper 14 is designed in a special way. Each pack row 11, 12 is completely enwrapped by itself, but at the same time both pack rows 11, 12 are wrapped in a common blank 22 which forms the outer wrapper 14. The blank 22 will be described in more detail in conjunction with FIG. 4. The two partial bundles 20, 21 abut one another in the region of large-surfaced front walls 23 and rear walls 24 of the cigarette packages 13. Inner walls 25, 26 of the outer wrapper 14 are located thereinbetween and are connected to one another in the region of narrow outer faces 27 of the bundle pack 10. Additionally, a weakening line 28 is disposed in the region of this connection, for example in the form of a perforation. In relation to the packages 13, the weakening line 28 is located approximately between the front walls 23 or rear walls 24 and the bottom faces 15 of oppositely situated pack top sides. The cut-outs 17 are arranged in outer faces 29 which are located opposite the weakening line 28. Consequently, the stability and the packaging utility of the outer wrapper 14 is ensured in a particularly reliable manner. To separate the two partial bundles 20, 21, they have to be unfolded about the weakening line 28. Adhesive spots 30 which are located between the inner walls 25, 26 prevent accidental unfolding. In order to be more effective, the adhesive spots 30 are arranged adjacent to the cut-outs 17. The required unfolding movement is indicated in FIG. 2 by means of a curved double arrow 31. The wrapper also comprises narrow side walls 32, 33, the former being located in the region of the weakening lines 28 and the latter in the region of the cut-outs 17. The outer front walls and rear walls of the cigarette packages are covered by outer walls 34, 35 of the outer wrapper 14.

The outer wrapper 14 is completed by end walls 36 and 37, 38 longitudinal side tabs which partly overlap in the finished outer wrapper 14. The longitudinal side tabs 37, 38 are connected to the side walls 32 and extend these side walls 32. As is evident from FIG. 2, the longitudinal side tabs 37, 38 are folded between the outer walls 25, 26 and the front walls 23 and rear walls 24 which are covered by the inner walls 25, 26.

Figure 3:
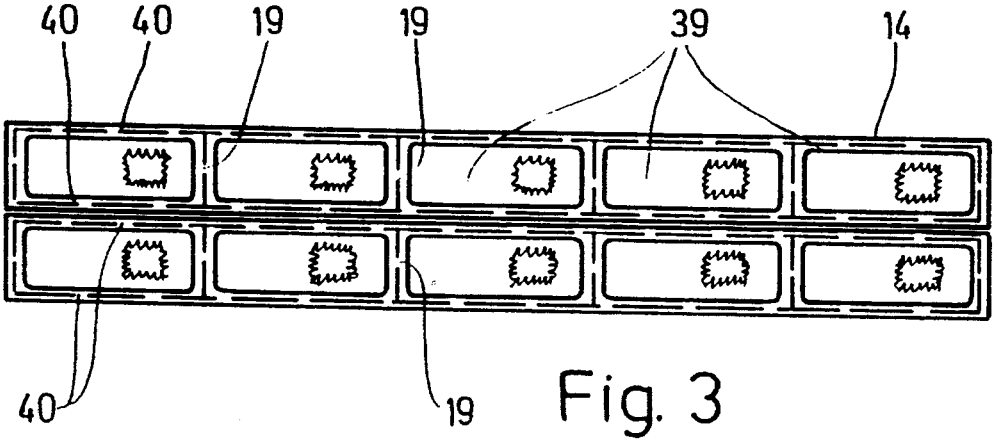
FIG. 3 is a side view of another example for a bundle pack according to the invention, similar to the pack of FIG. 1, but with smaller cut-outs in the narrow sides.

FIG. 3 illustrates a bundle pack 10 which is similar to that of FIGS. 1 and 2, but has slightly smaller cut-outs 39. In addition to the webs 19, the pack comprises edge portions 40 which are located transverse to the webs and delimit the cut-outs 39. This embodiment meets particularly high stability requirements.

Figure 4:
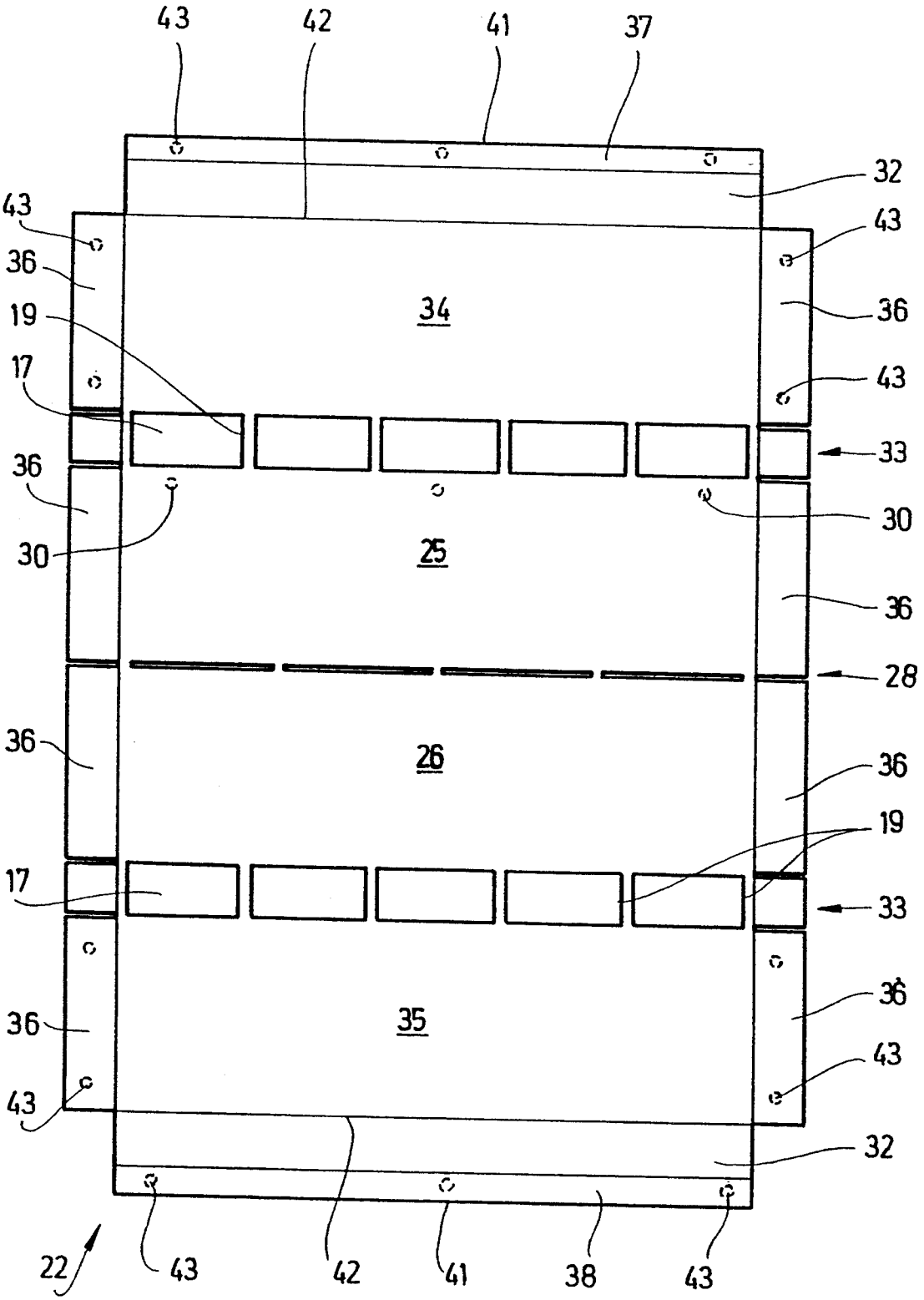
FIG. 4 shows a spread-out b lank for the bundle pack of FIGS. 1 and 2.

FIG. 4 illustrates a spread-out blank 22 for forming the outer wrapper 14 of FIG. 1. The blank 22 has an essentially rectangular shape, with narrow blank sides 41 extending parallel to the longitudinal edges 42 of the blank 22 which is folded to form the outer wrapper 14. The longitudinal edges 42, which are illustrated in FIG. 4 with solid lines, also form a longitudinal edge of the outer wall 34, 35. The weakening line 28 is disposed in parallel to the narrow blank sides 41 and approximately centrally between these two blank sides 41. From the center to the edge of the blank, the weakening line 28 is followed by an inner wall 25 or 26, the narrow side wall 33, an outer wall 34 or 35 and the side wall 32. Each side wall 32 is adjoined by a longitudinal side tab 37, 38. The cut-outs 17 are arranged in the region of the narrow side walls 33 and, accordingly, between the inner wall 25 and outer wall 34 or 26 and outer wall 35. The side tabs 36 and longitudinal side end walls 37, 38 are provided with adhesive spots 43 in order to fix the outer wrapper 14 when the bundle pack 10 is completed.

We claim:

1. A bundle pack containing a plurality of elongated cuboid cigarette packages (13) which are wrapped in an outer wrapper (14) made of cardboard, paper or plastic foil and each of which has a rectangular cross-section, wherein:

the bundle pack (10) comprises two longitudinally extending cuboid partial bundles (20, 21), each containing a row (11, 12) of side-by-side cigarette packages (13);

the cigarette packages (13) of each partial bundle (20, 21) are completely enwrapped by the outer wrapper (14), such that the outer wrapper (14) of each partial bundle (20, 21) forms an inner wall (25, 26) and, opposite thereto, an outer wall (34, 35), oppositely disposed elongated side walls (32, 33) each having a height, and oppositely disposed end walls (36);

the cigarette packages (13) are arranged within the rows (11, 12) so that the packages (15) abut one another at elongated side faces thereof and so that a substantially rectangular bottom face (15) of each package (13) faces one (33) of said side walls (32, 33), each bottom face (15) having a height;

the outer wrapper (14) contains, in said one side wall (33), side-by-side cut-outs (17) which expose the entire height of the bottom face (15) of each cigarette package (13) to permit the bottom face (15) to receive stamps or markings;

adjacent cut-outs (17) of the same said one side wall (33) are delimited from one another by transversely directed webs (19) which extend from the outer wall (34, 35) to the inner wall (25, 26);

along longitudinal sides thereof, the cut-outs (17) are directly delimited only by said inner wall (25, 26) and said outer wall (34, 35) so that each cut-out has a height that is the same as said height of said one side wall (33); and each cut-out (17) has a rectangular configuration having an area that nearly corresponds to the substantially rectangular bottom face (15) of each cigarette package (13), and has a height at least as great as the entire said height of said bottom face of each cigarette package.

2. The bundle pack as claimed in claim 1, wherein each web (19) covers adjacent edges (18) of narrow sides of adjacent packages in each row.

3. The bundle pack as claimed in claim 1, wherein two groups of individual packages (13) are wrapped in a common blank (22) in such a way that the bundle pack is separable into the two partial bundles (20, 21) by severing the wrapper (14) along a weakening line (28) in the wrapper.

4. The bundle pack as claimed in claim 3, wherein the weakening line (28) for severing the bundle pack into partial bundles (20, 21 ) is disposed on one side of the bundle pack (10), between the two rows of packages (13), and wherein the cut-outs (17) are arranged on the bundle pack (10) on a side thereof which is opposite said one side on which said weakening line is disposed.

5. A blank made of cardboard, paper or plastic foil for forming an outer wrapper of a finished bundle back (10) containing a plurality of cuboid packages (13), wherein:

the blank (22) has a longitudinally extending weakening line (28) along which the finished bundle pack (10) is separable into two partial bundles (20, 21);

the blank (22) has side-by-side cut-outs (17) in blank portions for forming respective side walls (33) of the partial bundles (20, 21) of the finished bundle pack (10), each side wall blank-portion having a height;

adjacent cut-outs (17) of a same side wall blank-portion (33) are delimited from one another by transversely directed webs (19) which extend from a blank-portion for forming an outer wall (34, 35) of the finished bundle pack to a blank-portion for forming an inner wall (25, 26);

along longitudinal sides thereof, the cut-outs (17) are directly delimited only by said inner wall blank-portion (25, 26) and said outer wall blank-portion (34, 35) so that each cut-out (17) has a height which is the same as said height of said each side wall blank-portion (33) and which is at least as great as a height of a bottom face of the packages (13) to be wrapped in the wrapper; and the cut-outs (17) have a rectangular configuration having an area that nearly corresponds to that of the bottom face (15) of the packages (13) to be wrapped so that each bottom face is exposed in a cut-out in the finished bundle pack.

* * * * *